US010131064B2

(12) United States Patent
Efthimiadis et al.

(10) Patent No.: US 10,131,064 B2
(45) Date of Patent: Nov. 20, 2018

(54) HANDLES FOR SHAVERS TO BE RELEASABLY CONNECTED TO SHAVING CARTRIDGES

(71) Applicant: BIC-VIOLEX SA, Anixi, Attiki (GR)

(72) Inventors: Dimitrios Efthimiadis, Nea Kypseli (GR); Ioannis Bozikis, Koukaki-Athens (GR)

(73) Assignee: BIC VIOLEX S.A., Anixi (GR)

( * ) Notice: Subject to any disclaimer, the term of this patent is extended or adjusted under 35 U.S.C. 154(b) by 78 days.

(21) Appl. No.: 15/303,610

(22) PCT Filed: Apr. 16, 2014

(86) PCT No.: PCT/EP2014/057771
§ 371 (c)(1),
(2) Date: Oct. 12, 2016

(87) PCT Pub. No.: WO2015/158382
PCT Pub. Date: Oct. 22, 2015

(65) Prior Publication Data

US 2017/0036363 A1 Feb. 9, 2017

(51) Int. Cl.
*B26B 21/52* (2006.01)
*B26B 21/22* (2006.01)

(52) U.S. Cl.
CPC ..... *B26B 21/521* (2013.01); *B26B 21/52* (2013.01); *B26B 21/528* (2013.01); *B26B 21/225* (2013.01); *B26B 21/522* (2013.01)

(58) Field of Classification Search
CPC ..... B26B 21/52; B26B 21/521; B26B 21/528; B26B 21/522; B26B 21/225
See application file for complete search history.

(56) References Cited

U.S. PATENT DOCUMENTS 4,841,638 A * 6/1989 Bardeen ..... B23D 51/01 30/332
5,016,352 A 5/1991 Metcalf
(Continued)

FOREIGN PATENT DOCUMENTS

CA 2894447 A1 * 6/2014 ..... B26B 21/222
CA 2894453 A1 * 6/2014 ..... B26B 21/222
(Continued)

OTHER PUBLICATIONS

International Search Report of PCT/EP2014/057771 dated Dec. 2, 2014.

*Primary Examiner* — Jennifer Swinney
(74) *Attorney, Agent, or Firm* — Polsinelli PC

(57) ABSTRACT

A handle for a shaver having a front portion, a removable shaving cartridge, an upper part and a lower part assembled together, and a movable button positioned in the front portion of the handle and configured to facilitate the removal of the shaving cartridge. The upper part of the handle has a slot with two longitudinal edges forming a pair of opposed tracks. The button has a pair of opposed flexible hooks which are snap-fitted with the longitudinal tracks of the slot and hold the button onto the handle. The lower part of the handle has an abutment member which is engaged between the flexible hooks. The abutment member is configured to prevent the flexible hooks from disengaging the tracks of the slot.

17 Claims, 11 Drawing Sheets

(56) References Cited

U.S. PATENT DOCUMENTS

| | | | | | |
|---|---|---|---|---|---|
| 5,027,511 | A * | 7/1991 | Miller | B26B 21/522 | 16/430 |
| 8,621,758 | B2 * | 1/2014 | Quintiliani | B26B 21/522 | 30/32 |
| 2006/0272154 | A1 * | 12/2006 | Brevard | B26B 21/446 | 30/41 |
| 2011/0239475 | A1 * | 10/2011 | Efthimiadis | B26B 21/521 | 30/526 |
| 2017/0326744 | A1 * | 11/2017 | Liberatore | B26B 21/521 | |

FOREIGN PATENT DOCUMENTS

| | | | | | |
|---|---|---|---|---|---|
| CA | 2894470 | A1 * | 6/2014 | B26B 21/222 | |
| GB | 2078589 | A * | 1/1982 | B26B 21/225 | |
| GB | 2086790 | A * | 5/1982 | B26B 21/225 | |
| WO | WO 2008/094488 | A1 | 8/2008 | | |
| WO | WO 2010/037418 | A1 | 4/2010 | | |

* cited by examiner

HANDLES FOR SHAVERS TO BE RELEASABLY CONNECTED TO SHAVING CARTRIDGES

This application is a national stage application of International Application No. PCT/EP2014/057771, filed Apr. 16, 2014, the entire contents of which is incorporated herein by reference.

FIELD OF THE INVENTION

The embodiments of the present invention are concerned with shaver handles to be releasably connected to shaving cartridges, and shavers including such handles.

In particular, the invention relates to a shaver handle including:

- an elongated handle body terminating in a flexible yoke for receiving and releasably retaining a shaving cartridge,
- a slide element cooperating with the yoke and connected to the handle body, the slide element being movable relative to the handle body between a rest position, in which the yoke can releasably retain a shaving cartridge received in the yoke, and a release position, in which the yoke is flexed and can receive a shaving cartridge or release a shaving cartridge received in the yoke, and
- an elastic element to return said slide element from the release position to the rest position.

Such a shaver handle allows a shaving cartridge connected to it to be retained when in use, and to be released after use. After one or several uses, the user can replace the shaving cartridge, while keeping the shaver handle for re-use.

BACKGROUND

A shaver, for example in WO2010037418, can include a handle with a flexible yoke. The handle is provided with a button, which is adapted to bring the arms of the yoke closer together. A cartridge is usually retained by shell bearings, provided at the end of the arms. When the cartridge is to be removed, the button is moved forward in a direction towards the cartridge. The arms of the yoke are moved closer together by the action of the button, while at the same time the button pushes the cartridge away from the shell bearings. The cartridge is consequently removed and can be replaced.

The handle, as in WO2010037418, can be a one-piece plastic handle provided with a button. However, for several reasons it may be desirable to manufacture the handle in multiple pieces. Such multiple pieces must then be prevented from disassembly when a force is applied to the handle, for example when the shaver is dropped or otherwise exposed to a shock. At the same time, the multiple pieces must allow for an easy assembly of all the pieces together.

SUMMARY OF THE INVENTION

To this aim, according to the invention, a handle for a shaver is provided, including:

- a front portion configured to receive a removable shaving cartridge,
- an upper part, and a lower part, the upper part and the lower part being assembled together,
- a button positioned in the front portion of the handle, the button being movable in a first direction and configured to facilitate the removal of the shaving cartridge,

- wherein the upper part of the handle includes a slot extending longitudinally in the first direction, the slot having two longitudinal edges forming a pair of opposed tracks,
- wherein the button includes at least one pair of opposed flexible hooks which are snap-fitted with the longitudinal tracks of the slot and hold the button onto the handle, the flexible hooks being slideable on the tracks,
- wherein the lower part of the handle includes an abutment member which is engaged with the flexible hooks and is elongated in the first direction, the abutment member being adapted to prevent the flexible hooks from disengaging the tracks of the slot.

In some embodiments of the invention, one may use one or more of the following features:

- wherein the upper part of the handle and the lower part of the handle are assembled together by snap-fitting;
- the button is slideable;
- the button includes a front portion adjacent the cartridge and a rear portion, and wherein the button is adapted to remove the cartridge when the button is moved;
- the flexible hooks are provided in a form of outwardly oriented hooks, and the abutment member is positioned between the flexible hooks to prevent the flexible hooks from being moved closer together;
- the slot includes a stop projection protruding inside the slot, the stop projection being adapted to prevent the flexible hooks from moving closer together;
- the button includes a front portion adjacent the cartridge and a rear portion, the button is slideable and configured to remove the cartridge when the button is slid forward, the flexible hooks are positioned in the rear portion of the button, and the abutment member engages the flexible hooks when the button is slid forward, while the stop projection engages the flexible hooks when the button is not slid forward;
- the front portion of the upper part of the handle includes a receptacle, the front portion of the lower part of the handle is terminated in a hook, configured to engage the receptacle, and the rear portions of the upper and lower parts of the handle are provided with press-fitting means;
- the abutment member is positioned adjacent the hook;
- the handle is adapted to accommodate a pivoting cartridge, the handle further including a plunger adapted to return the cartridge into a rest position when pivoted;
- each of the pairs of the holding members forms a space between the holding members for accommodating the plunger;
- the button further includes a track configured to provide guidance for the plunger;
- the button is provided with a spring, the spring configured to provide a return force for the button when the button is slid forward;
- the plunger is provided with the spring, and the spring provides return force for both the button and the plunger.

In another aspect of the present invention, a method of manufacture of a handle for a shaver is provided; the method includes:

- providing a button, the button including at least one pair of opposed flexible hooks,
- providing a handle upper part, the handle upper part including a slot extending longitudinally in a sliding direction, the slot having two longitudinal edges forming a pair of opposed tracks, providing a handle lower part, the handle lower part including an abutment member, snap-fitting the flexible hooks provided on the button respectively to the tracks of the slot on the handle upper part so that the button is slideable in said sliding direction, fitting the handle lower part to the handle upper part to form the handle, and simultaneously engaging the flexible hooks to the abutment member of the handle lower part so that said abutment member forbids disengagement of the hooks from the tracks of the slot.

The handle upper part may further include a stop projection, protruding inside the slot, the method may further include providing a spring and assembling the button and the spring, wherein during the step of fitting, the hooks are snap fitted at a position offset from the stop projection, wherein the method further includes, between the step of snap fitting the flexible hooks and the step of snap-fitting the handle lower part, engaging the flexible hooks to the stop projection, wherein the spring biases the button to a rest position where the stop projection is between the hooks and prevents disengagement of the hooks from the tracks of the slot, and wherein at the step of snap-fitting the handle lower part, the abutment member of the handle lower part is positioned in alignment with the stop projection in the sliding direction.

With these features, the shaver handle is not easily disassembled, in particular in a situation when a force is applied to the handle (when the handle is exposed to shock, dropped etc.). In particular, it is less likely that the button will be disassembled and/or damaged when a force is applied to the handle.

BRIEF DESCRIPTION OF THE DRAWINGS

Other characteristics and advantages of the invention will readily appear from the following description of one of its embodiments, provided as non-limitative examples, and of the accompanying drawings.

On the drawings.

On the different Figures, the same reference signs designate like or similar elements.

DETAILED DESCRIPTION

Figure 1A:
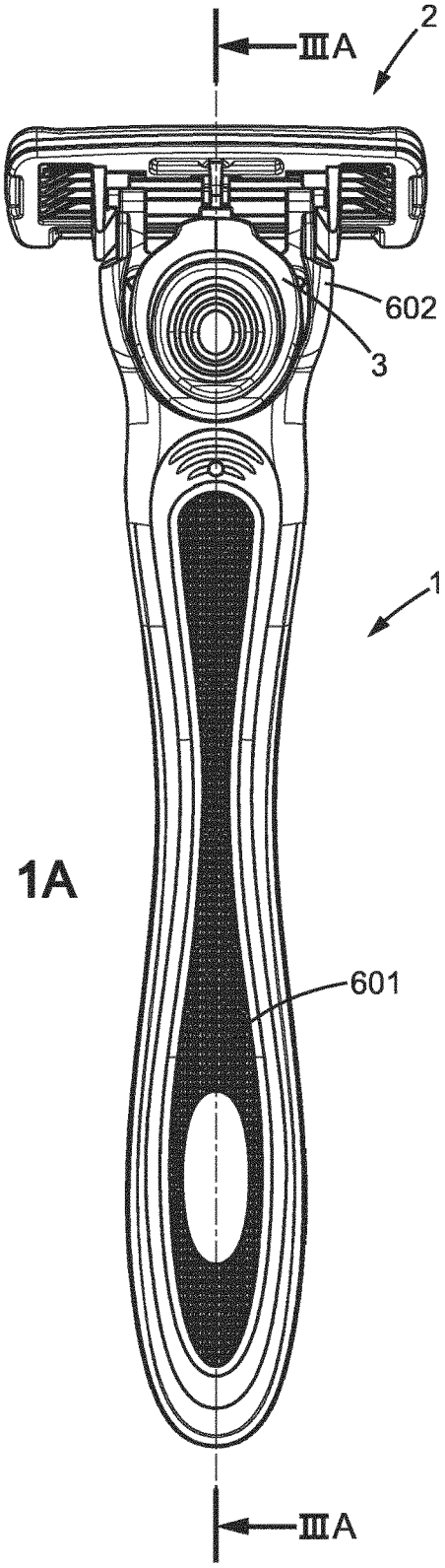
FIG. 1A is a top view of the shaver.
Figure 1B:
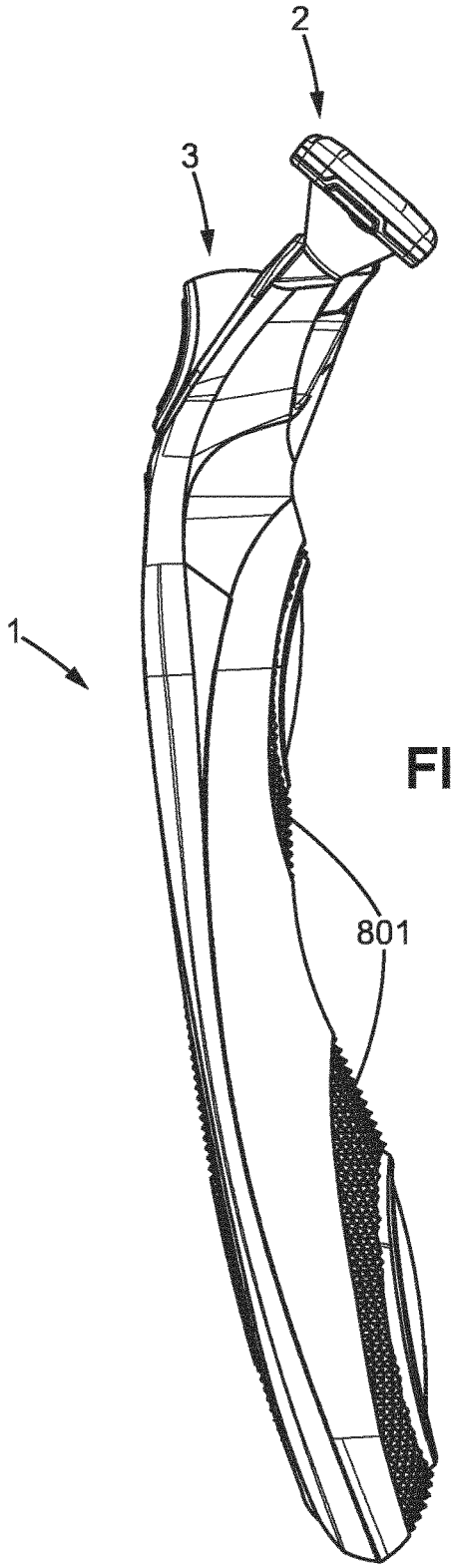
FIG. 1B is a side view of the shaver.
Figure 2:
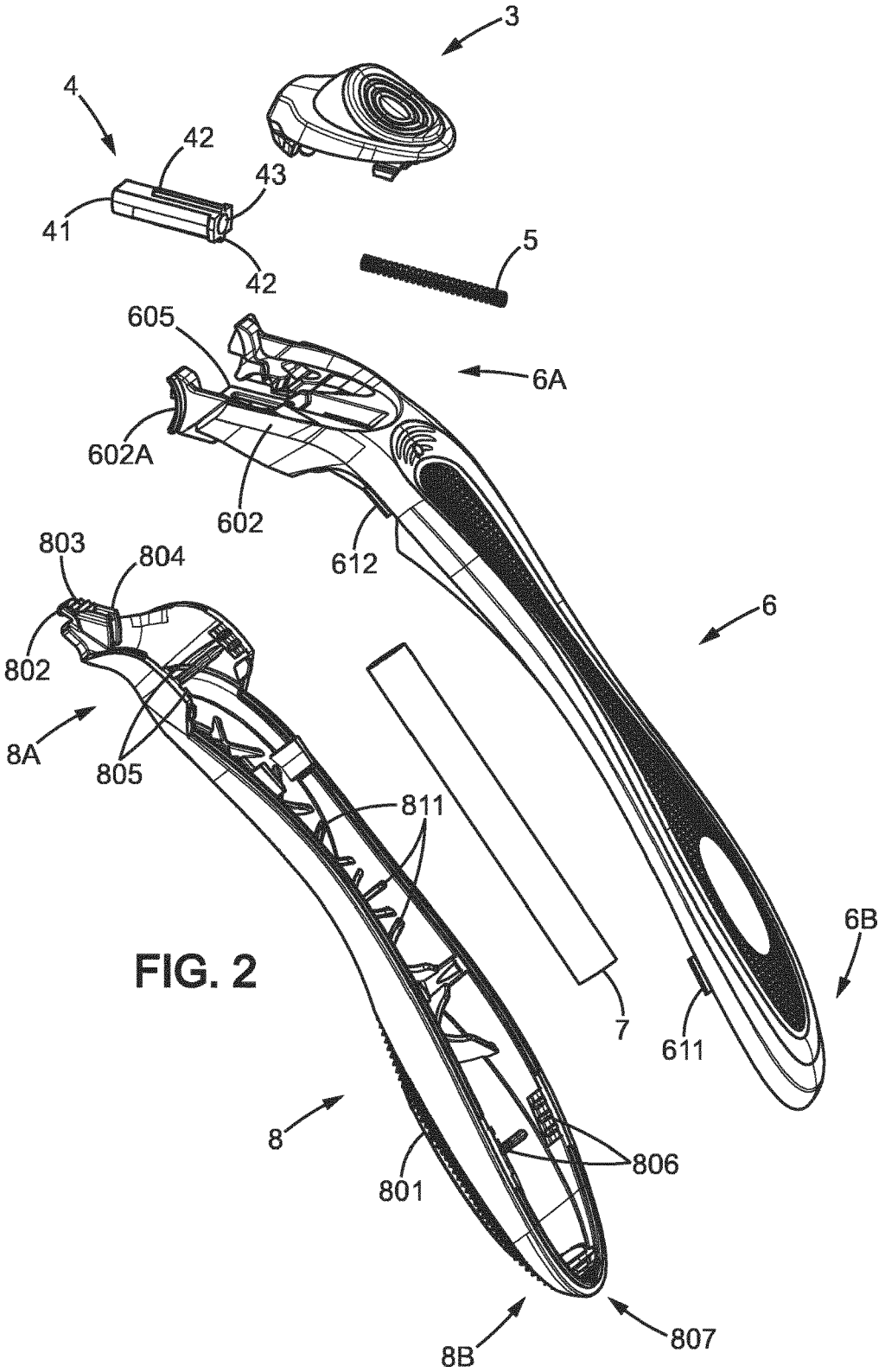
FIG. 2 is an exploded view of the shaver.

FIGS. 1A, 1B and 2 show an overall view of an example embodiment of the present invention. The shaver according to this example includes a handle 1 and a cartridge 2.

The handle 1 includes a cartridge-receiving region positioned at the front portion 6A, 8A of the handle 1. The cartridge 2 may be any cartridge known from the art. The cartridge 2 may include one or more blades. The blades (not shown in detail) have sharp edges, which are elongated in one direction; the blades are positioned parallel to each other in the cartridge 2. The position of the blades defines a direction of shaving, as well as a direction of the blades, which is perpendicular to the direction of shaving.

The cartridge 2 is preferably mounted pivotally on the handle 1. To this end, the cartridge 2 and the handle 1 may be provided with any known pivoting means. In the example from the Figures, the handle 1 is provided with a pair of shell bearings 602A, positioned at the end of arms 602. The shell bearings 602A cooperate with corresponding features provided on the cartridge 2, and ensure that the cartridge 2 may move pivotally with respect to the handle 1 when subjected to shaving forces. However, other pivoting means may be used, such as pins and corresponding holes, or the like.

To ensure the return of the cartridge 2 into the rest position after being pivoted, the handle 1 may be provided with biasing means. In the below described example, the handle 1 is provided with a plunger 4 serving as biasing means; the plunger is shown on FIG. 2. However, other biasing means may be utilized, such as elastic tongue, leaf spring, latch, or the like.

The plunger 4 is powered by a spring element 5. The spring element 5 may be for example a coil spring.

In the example shown in the Figures, the plunger 4 is provided in a form of an elongated body. The elongated body may be prism shaped; for example, the elongated body is cuboid-shaped and includes four elongated walls, as seen in the Figures. The plunger 4 may also take any other suitable shape, such as a cylinder. The plunger 4 further includes at least one guiding protrusion 42. The guiding protrusion 42 protrudes outwardly from the elongated outer wall of the plunger 4. There are at least two guiding protrusions 42. The guiding protrusions 42 are positioned on two opposite sides of the plunger 4. The guiding protrusions 42 are adapted to cooperate with corresponding features provided on the front portion 6A of the upper part of the handle 6; the protrusions 42 may also be adapted to cooperate with corresponding features provided on the button 3. This will be described below.

As shown on FIG. 2, the portion of the plunger 4 which is oriented towards the handle 1 and away from the cartridge 2 may include a hole 43, in which the coil spring 5 may be inserted. The hole 43 then guides the coil spring 5, protects the coil spring 5, and helps to ensure that the coil spring 5 is not overloaded or deformed in a wrong direction. This in turn helps to prevent the displacement of the plunger 4. The hole 43 extends through at least half of the length of the plunger 4.

The handle 1 is shaped so as to enable the user to grip the handle 1 comfortably, as can be seen on FIGS. 1A and 1B. The handle 1 may be elongated along an axis generally perpendicular to the blade edges; the handle 1 thus defines a longitudinal axis of the shaver. The handle 1 may be straight or curved, for example to an overall S or U shape.

The handle 1 may further include several convex and/or concave portions for inserting the user's finger and thus enhancing the grip.

The handle 1 may be made of plastic. The handle 1 includes at least one grip area 601, 801. The grip areas 601, 801 may be at least partly covered in an elastomeric material, such as rubber, silicone, or the like. The elastomeric material may be further provided with protrusions or patterned surface to further enhance the grip.

The handle 1, as shown for instance in FIG. 2, is formed as an assembly of several pieces. The handle 1 has an upper part 6 and a lower part 8. The upper part 6 and the lower part 8 both form a shell-like structure, with an inner surface and an outer surface. The upper part 6 and the lower part 8 of the handle 1 are assembled together; an inner space is formed between the upper part 6 and the lower part 8.

In order to facilitate assembly, and to hold the upper part 6 and the lower part 8 together, both the upper part 6 and the lower part 8 are provided with holding means. The holding means may be provided as means using for example snap-fitting, press-fitting, magnetic force, adhesives, ultrasonic welding, or any other suitable holding force. The upper part 6 and the lower part 8 of the handle 1 are held together at least one point. There can be a plurality of points holding the parts of the handle 1 together. Providing a plurality of such points reinforces the handle 1.

Figure 3A:
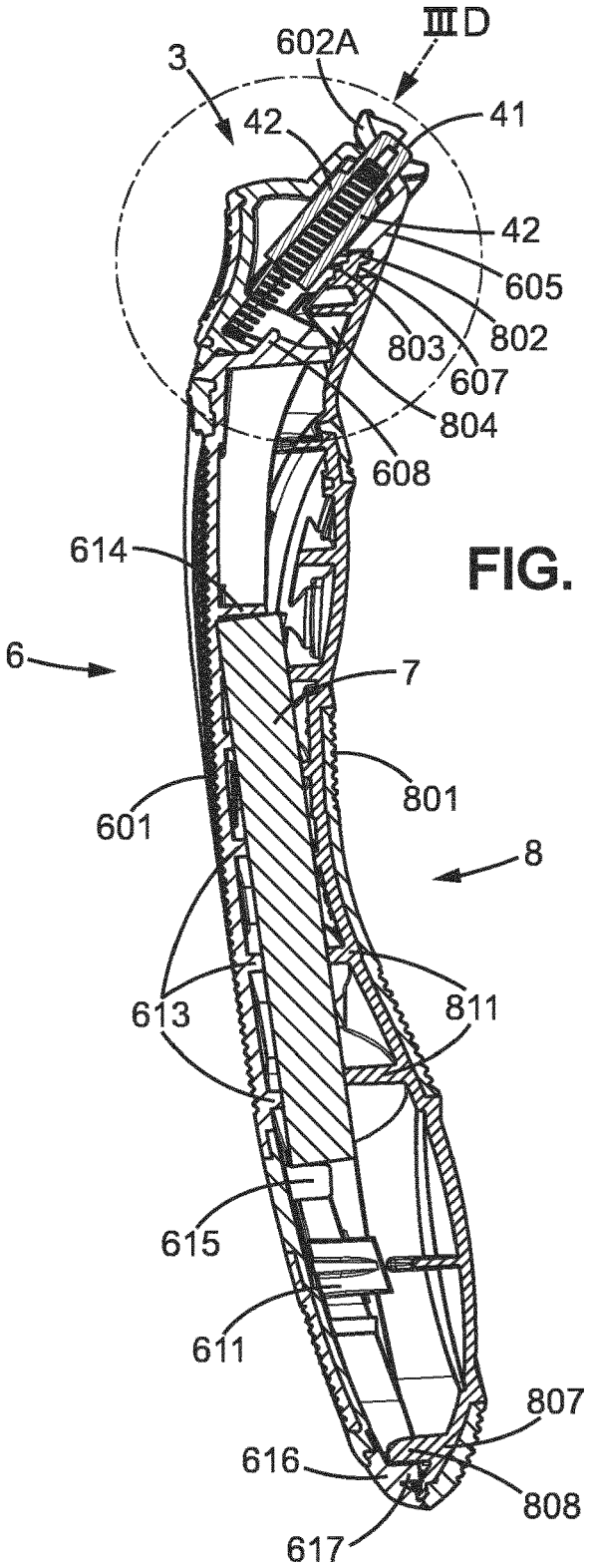
FIG. 3A is a cross-sectional view of the handle (without a cartridge) along line A-A.
Figure 3B:
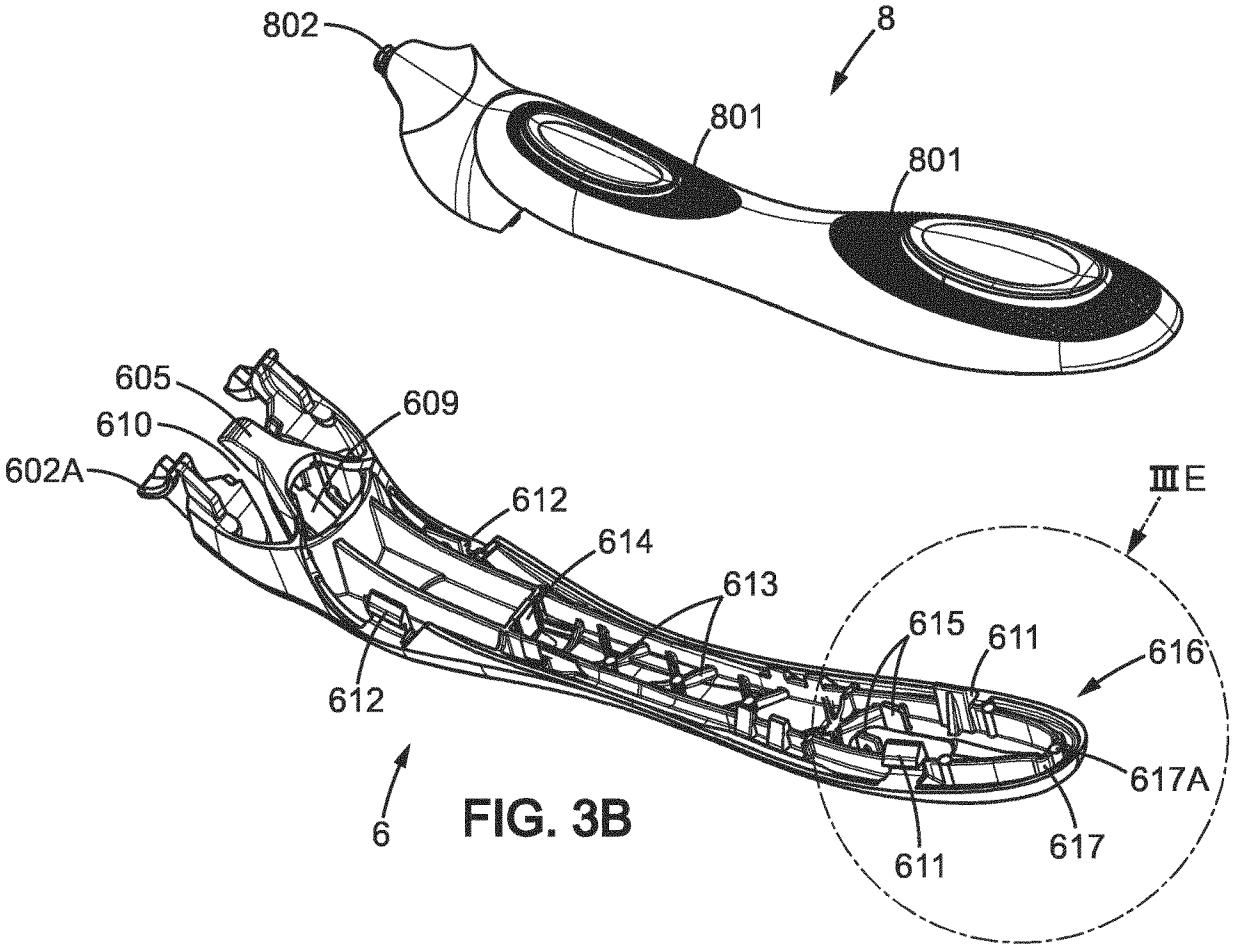
FIG. 3B is a detail of the inner surface of the upper part of the handle.
Figure 3C:
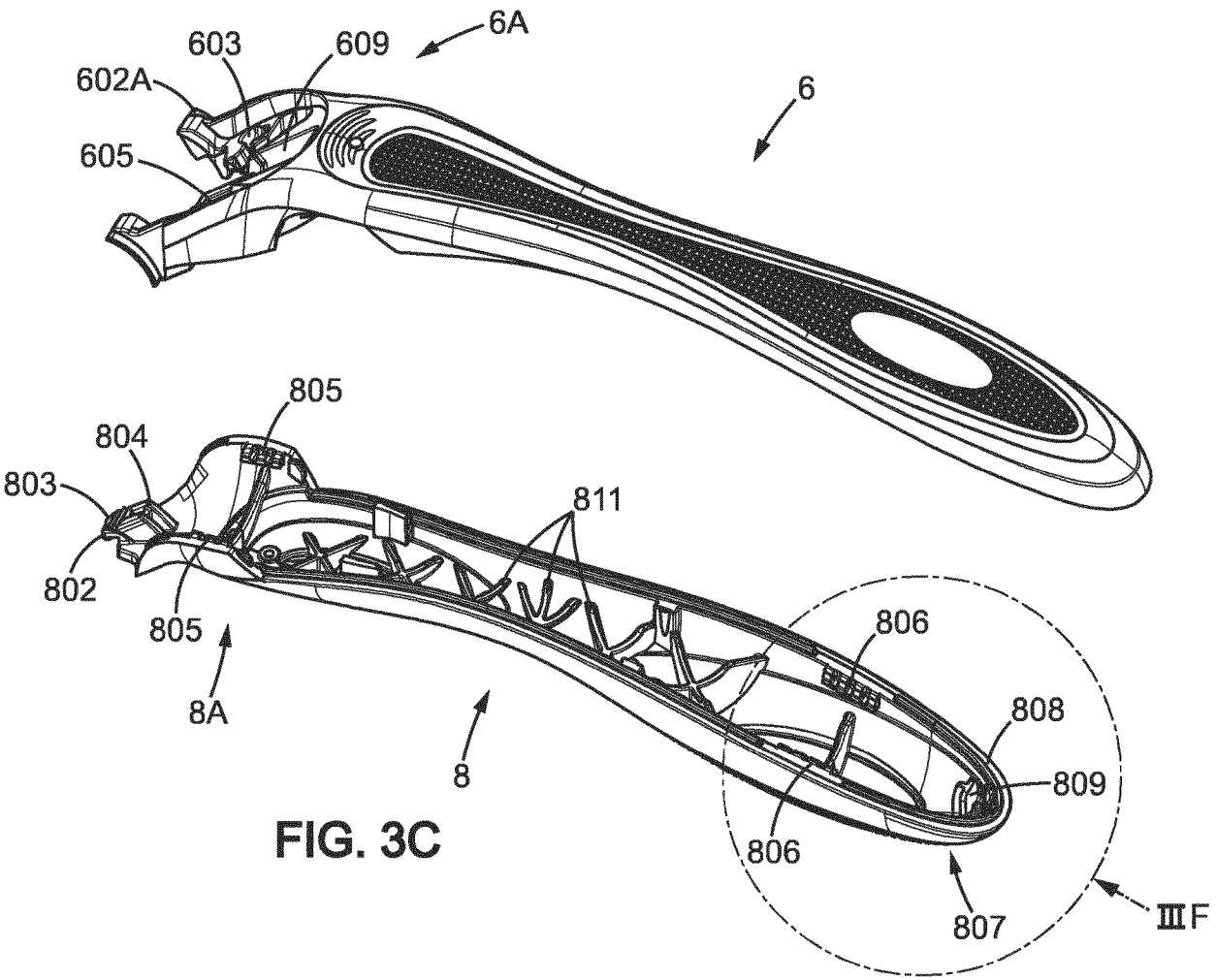
FIG. 3C is a detail of the inner surface of the lower part of the handle.
Figure 3D:
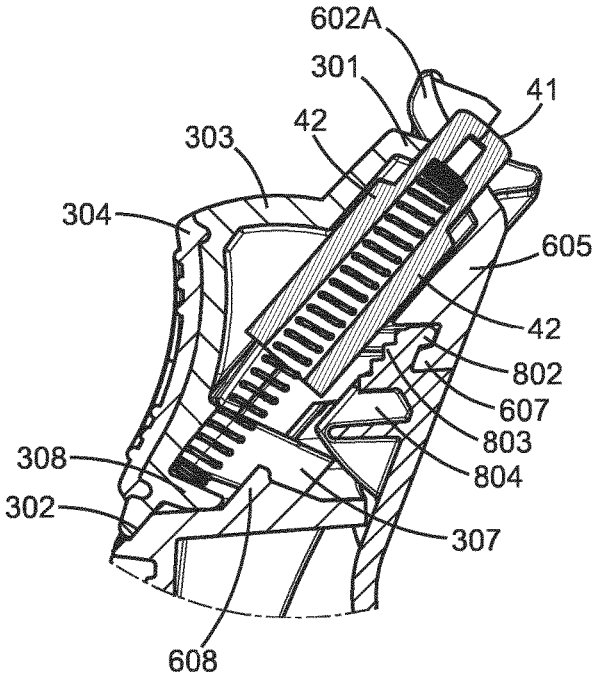
FIG. 3D is a detail of the cross-section of the front portion of the handle along line A-A.
Figure 3E:
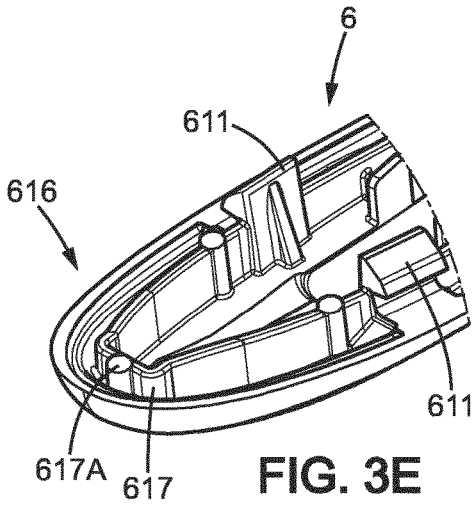
FIG. 3E is a detail of the rear portion of the upper part of the handle.
Figure 3F:
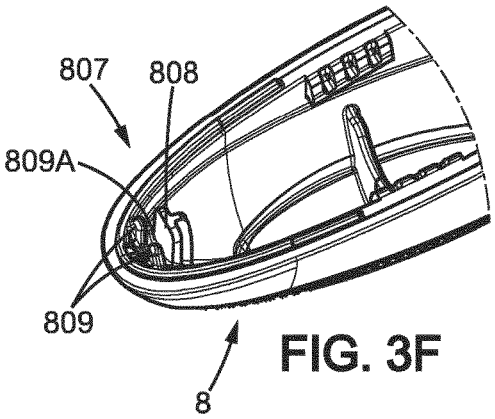
FIG. 3F is a detail of the rear portion of the lower part of the handle.

In the example shown in the Figures (see FIGS. 3A to 3F for details), the holding means include two pairs of hooks and receptacles 611, 806, 612, 805; however, any number of such pairs may be employed. FIGS. 3B and 3C show an example of the hooks 611, 612 that are configured to be snap-fitted with the receptacles 806, 805. Upon assembly of the handle 1, the hooks 611, 612 engage the respective receptacles 806, 805. One pair of the hooks 611 and corresponding receptacles 806 is positioned adjacent the front portions 6A, 8A of the handle 1. Another pair of the hooks 612 and corresponding receptacles 805 may be positioned adjacent the opposite end 6B, 8B of the handle 1. In this way, the upper and lower parts 6, 8 of the handle 1 are held together; the holding forces are distributed sufficiently uniformly.

The handle 1 may further include additional holding means. The additional holding means may be positioned in at least one extremity of the handle 1. The additional holding means are positioned in or adjacent to both the extremities of the handle 1.

As an example, the rear portion 6B of the upper part 6 of the handle 1 may be provided with upper press-fitting means 616. The rear portion 8B of the lower part of the handle 1 may be provided with lower press-fitting means 807. An example is shown on FIGS. 3E and 3F.

The upper press-fitting means 616 may include a wall 617. The wall 617 protrudes from the upper part 6 of the handle 1. The wall 617 further includes a peg 617A. The peg 617A is formed as a lateral protrusion positioned in the middle of the wall 617. The peg 617A may be substantially circular. It may also take any other suitable shape.

The lower press-fitting means 807 are compatible with the upper press-fitting means 616; the lower press-fitting means 807 are configured to accommodate and hold the peg 617A so that the peg 617A does not move unwantedly. The lower press-fitting means 807 may for example have a plurality of protrusions 808, 809. The protrusions 808, 809 extend upwards from the lower part 8 of the handle 1. The protrusions are arranged so as to allow the peg 617A to be press-fitted between them. As shown in the Figures, the protrusion 808 is formed as a platform. The protrusion 809 is two-pieced, with a centered gap 809A, into which the peg 617A may be easily fitted. The peg 617A is then prevented from further movements, such as twisting, turning or sliding. This in turn helps to stabilize the connection of the rear portions 6B, 8B of the handle 1.

With the above described press-fitting means 616, 807, it is more difficult to disassemble the handle 1 from its rear end, and thus the resiliency of the handle 1 is boosted.

The front portion 6A, 8A of the handle 1 is also provided with additional holding means. These may for example take a form of a hook 802 and a compatible hook-like receptacle 607. The hook 802 and the hook-like receptacle 607 are oriented so as to fit into each other, as can be seen on FIG. 3D.

The front portion 8A of the lower part 8 of the handle 1 is projecting from the lower part 8 of the handle 1 towards the upper part 6 of the handle 1. The front portion 8A of the lower part 8 of the handle 1 terminates in the hook 802. The upper face 803 of the hook 802 is preferably roughened, i.e. provided with a friction-increasing pattern. In the example shown in the Figures (see e.g. FIG. 3D), the upper face 803 of the hook 802 takes a shape of small triangles. However, other friction-increasing patterns may be used. The friction increasing pattern provided on the upper face 803 of the hook 802 serves to facilitate demoulding. It may also further prevent the disassembly of the handle 1.

An abutment member 804 is positioned adjacent to and behind the hook 802. The abutment member 804 prevents flexible hooks 307 of the button 3 (will be described later) from being brought closer together. The abutment member 804 thus helps to prevent the disengagement of the button 3, and disassembly of the handle 1, when the handle 1 is dropped or exposed to shock.

The length of the abutment member 804 may be similar to the length of a slot 609 which is provided in the upper part 6 of the handle 1 (described below). The abutment member 804 may extend along the whole length of the slot 609. The abutment member 804 may also extend along just part of the length of the slot 609, for example along about half the length of the slot 609, or along about three-quarters of the length of the slot 609. In such case, a stop projection 608 (will be described later) may be provided in the protrusion 609 for further preventing the button 3 from disengagement.

In at least one embodiment of the present invention, the abutment member 804 may be further adapted to accommodate and guide the guiding protrusion 42 provided on the plunger 4. The abutment member 804 may be used to help to guide the plunger 4. The abutment member 804 may be configured to be used in a situation when the plunger 4 is displaced and there is a risk of disassembly of the plunger 4, the button 3 and the handle 1. In such a situation, the abutment member 804 provides the necessary support for the plunger 4, preventing the plunger 4 from being further displaced, and thus helps to prevent damage to the handle 1. The upper face 803 of the hook 802 further enhances this function.

The handle 1 may optionally be provided with an insert 7. The insert 7 is input between the upper part 6 and the lower part 8 of the handle 1. In at least one embodiment of the present invention, the insert 7 is positioned substantially in the middle of the handle 1, between the front portion 6A, 8A and the rear portion 6B, 8B of the handle 1.

The insert 7 can be formed as a solid body. The insert 7 may be shaped as a cylinder, as shown on FIG. 2. The insert 7 may also take any other suitable shape such as prism or the like. The body may be made, for example, of metal. The body may be also made of plastic, wood, or any other suitable material. When the insert 7 is provided, the insert 7 may serve to provide additional weight to the handle 1, thus enhancing the control during shaving and improving user's experience. The insert 7 may also serve to reinforce the handle 1, and to prevent excessive deformation of the handle 1. This in turn helps to avoid disassembly of the handle 1.

As shown on FIG. 2, the insert 7 may be positioned between insert supports 614, 615, provided on the upper part 6 of the handle 1. The supports 614, 615 protrude downwards from the inner surface of the upper part 6 of the handle 1. Each of the supports 614, 615 may contact at least one base side of the insert 7. In this way, the supports 614, 615 help to prevent the unwanted back-and-forth movement of the insert 7 in the handle 1. The supports 614, 615 may also serve as a further reinforcement of the handle 1, thus improving its resiliency. The insert 7 is further supported by insert supports 811, provided on the inner surface of the lower part 8 of the handle 1; an example of the insert supports is illustrated on FIG. 3C. When the handle 1 is assembled, the insert supports 811 abut the insert 7, and the insert 7 is positioned so as to be resting on the insert supports 811. The supports 811 are shaped so as to provide a seating for the insert 7, and to prevent its side movement. The example shown in FIG. 3C shows the insert supports 811 in form of small cross-shaped and/or star-shaped crossbars, protruding upwards from the inner surface of the lower part 8 of the handle 1. These supports 811 may also serve to further reinforce the handle.

As is shown on FIG. 3B, the upper part 6 of the handle 1 may be provided with analogous insert supports 613.

The front portion 6A of the upper part 6 of the handle 1 includes a lock and release mechanism, which is configured to hold the cartridge 2 in place, and to release the cartridge 2 when the cartridge 2 needs to be replaced. The front portion 6A of the upper part 6 of the handle 1 (an example is illustrated on FIGS. 5A, 5B) is further adapted to cooperate with the button 3. The button 3 is adapted to facilitate the removal of the cartridge 2 when the cartridge 2 needs to be replaced. The removing of the cartridge 2 is described in detail below.

Figure 5A:
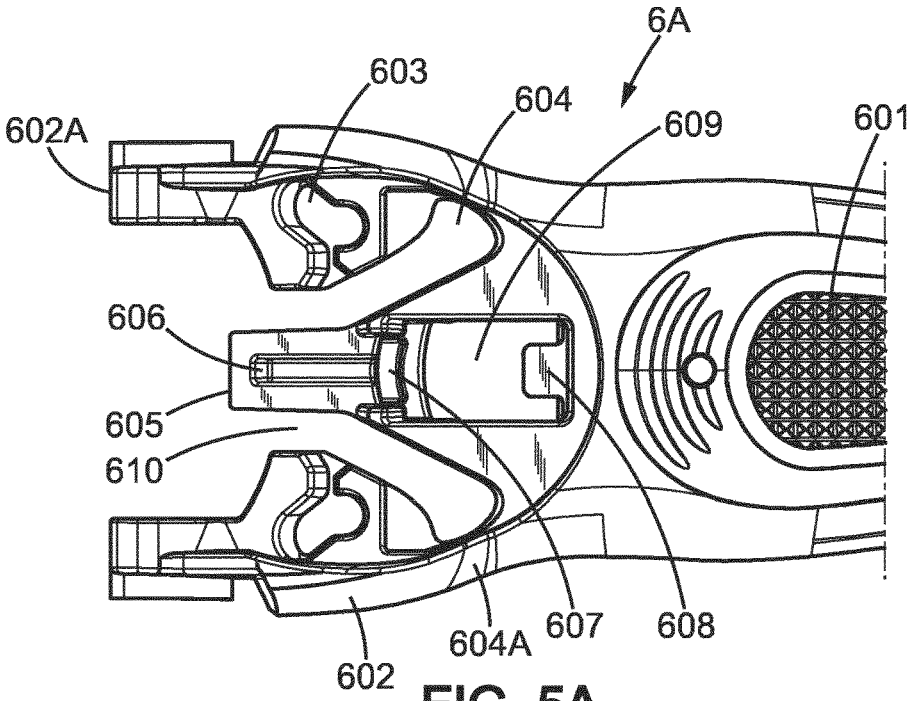
FIG. 5A is a detail of the front portion of the upper part of the handle viewed from above.
Figure 5B:
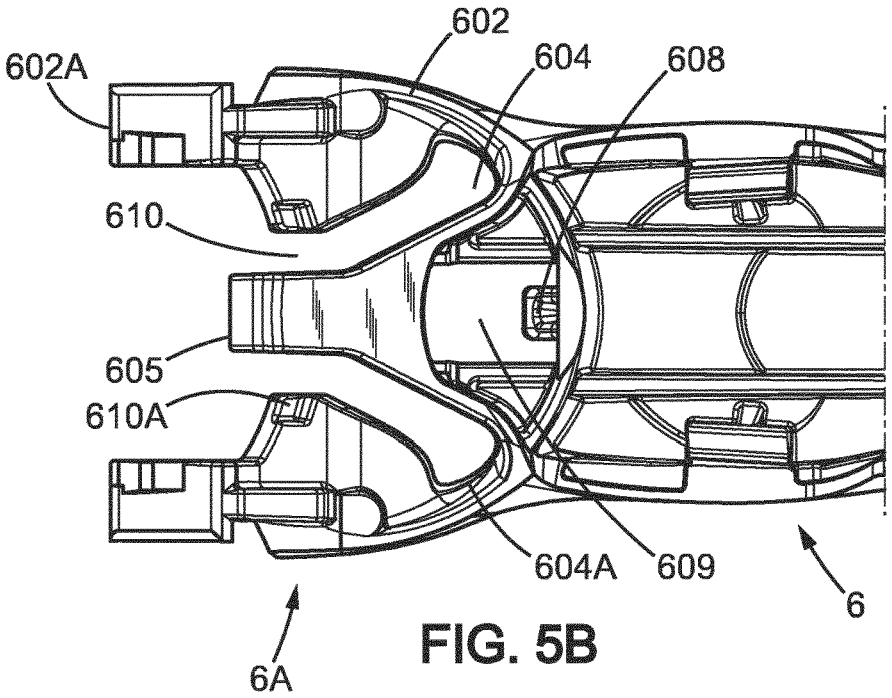
FIG. 5B is a detail of the front portion of the upper part of the handle viewed from below.
Figure 6:
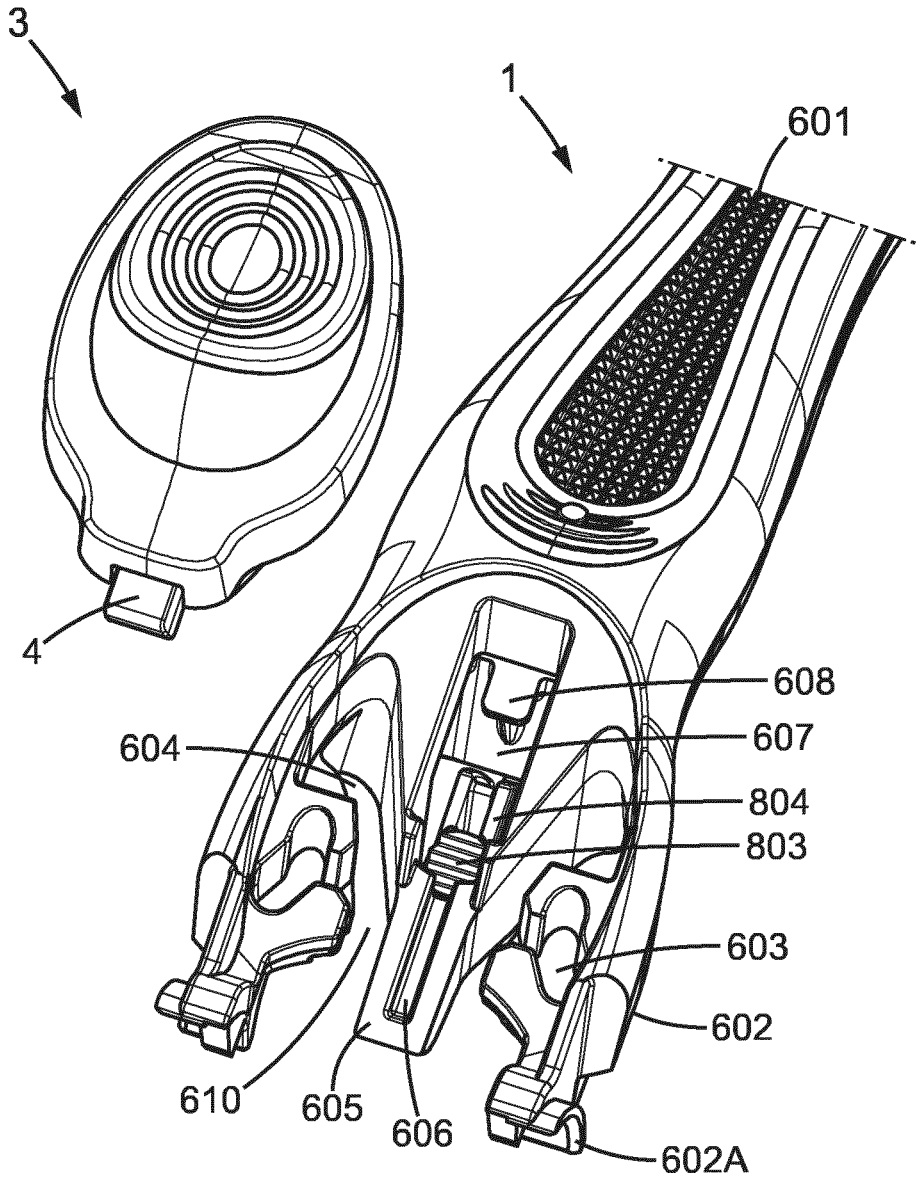
FIG. 6 shows a perspective view of the handle and the button.

The front portion 6A of the upper part 6 of the handle 1 is formed as a flexible yoke; detail of the yoke can be seen on FIGS. 5A (top view) and 5B (bottom view). The yoke includes two arms 602. Each arm 602 of the yoke terminates in a shell bearing 602A. The shell bearings 602A cooperate with corresponding features provided on the cartridge 2 to ensure the cartridge 2 may be pivoted. When the cartridge 2 is to be released, the arms 602 are flexed to be brought closer together. The cartridge 2 may thus be disengaged from the shell bearings 602A and removed/replaced.

FIG. 5A shows that each of the arms 602 has a receptacle 603. The receptacle 603 is provided on the upper surface of each respective arm 602. The receptacle 603 may be of non-linear shape. For example, the receptacle 603 may be of a substantially bean-like shape. The receptacles 603 are adapted to receive pins 306 provided on the button 3. The receptacles 603 and the pins 306 cooperate to bring the arms 602 closer together and to release the cartridge 2 (will be described later).

The arms 602 are connected to the handle 1 via a flexible portion 604A. The flexible portion 604A allows the arms 602 to be brought closer together. In the example given in FIG. 5A, the increased flexibility of the flexible portion 604A is achieved by narrowing the respective portion of the arm 602 adjacent the grip area 601 of the handle 1.

Between the arms 602, a platform 605 is positioned. The platform 605 serves multiple purposes. It provides a support for the plunger 4. Further, it locks the button 3 in its position and helps to prevent the disengagement of the button 3. The cooperation with the button 3 will be described later.

The platform 605 (example is shown on FIGS. 3D, 5A and 5B) can take an overall shape of a prism. The walls of the platform 605 that are adjacent to the arms 602 (side walls of the platform 605) are parallel to the longitudinal axis of the shaver.

The platform 605 includes an upper wall, the upper wall being oriented towards the button 3. The upper wall of the platform 605 includes a track 606. The track 606 is configured to receive one of the guiding protrusions 42 provided on the plunger 4. The track 606 then helps to guide the plunger 4 to reciprocate linearly, reducing risk of the plunger 4 being displaced or misguided in a wrong direction. Therefore, a risk of damage of the plunger 4 is lowered, and the function of the cartridge 2 returning to its rest position is enhanced.

The arms 602 and the platform 605 are separated from each other by non-linear slots 604. The non-linear slots 604 are provided between the platform 605 and each respective arm 602. Each of the non-linear slots 604 has a portion defining a linear part 610. The linear part 610 is configured to cooperate with the button 3, namely with locators 305 provided in the front part of the button 3. The cooperation of these features will be described below.

Between the grip area 601 of the upper part 6 of the handle 1 and the platform 605 a slot 609 is formed. The slot 609 is of substantially rectangular shape. The slot 609 extends through the upper part 6A of the handle 1, thus forming an opening through the upper part 6 of the handle 1. This is shown on FIGS. 5A and 5B.

The slot 609 may be elongated in one direction which is parallel to the longitudinal axis of the shaver. The walls of the slot 609 parallel to the longitudinal axis of the shaver (side walls of the slot 609) are parallel to each other, and also to the side walls of the platform 605. The side walls of the slot 609 may be provided substantially in one line with the side walls of the platform 605. The side walls form two longitudinal edges forming a pair of opposed tracks. The tracks are adapted to receive flexible hooks 307 of the button 3 (will be described later).

The wall of the slot 609 that is adjacent the grip area 601 may include a stop projection 608. The stop projection 608 protrudes into the slot 609. The upper wall of the stop projection 608 is aligned with the upper wall of the platform 605. In this way, the stop projection 608 does not interfere with the possible movements of the plunger 4. The stop projection 608 prevents flexible hooks 307 of the button 3 (will be described later) from being brought either closer together, or, in an alternative embodiment, further apart. The stop projection 608 thus helps to prevent the disengagement of the button 3, and disassembly of the handle 1, when the handle 1 is dropped or exposed to shock.

At the end adjacent to the platform 605, the wall of the slot 609 is provided with a hook-like receptacle 607. Detail of the cross-section of the hook-like receptacle 607 can be seen on FIG. 3D. The hook-like receptacle 607 is adapted to receive the hook 802, provided on the front portion 8A of the lower part 8 of the handle 1 (described above).

The front portion 6A of the upper part 6 of the handle 1 is adapted to receive a release button 3. An example of such button 3 is shown in FIGS. 4A to 4D. The button 3 is preferably formed as a body with a protruding part 303. The protruding part 303 protrudes upwards, away from the handle 1. The protruding part is adapted for the user to engage the protruding part 303 with his/her finger; the button 3 is then to be pressed. To this end, the protruding part 303 may be provided with a finger rest portion 304. The finger rest portion 304 is positioned so as to enable easy pressing of the button 3 and moving the button 3 forward, towards the cartridge 2. The finger rest portion 304 may be substantially concave, as seen on FIGS. 4A to 4D. The finger rest portion 304 may be provided with ribs, pegs or other protrusions for enhancing the grip. The finger rest portion 304 may be covered in suitable elastomeric material, such as rubber, silicone or the like.

The button 3 has a pushing face 301. The pushing face 301 is oriented towards the cartridge 2. When the cartridge 2 is to be removed, the button 3 is pressed and thus moved forward, towards the cartridge 2. In such a situation, the pushing face 301 engages the cartridge 2 and pushes the cartridge 2 away from the handle 1. Thus, the cartridge 2 may be removed without the user having to touch the cartridge 2.

The lower portion of the button 3 can be seen on FIGS. 4A to 4D. The lower portion of the button 3 has a pair of lockers 305. The lockers 305 protrude downwards from the button 3, in a direction of the front portion 6A of the upper part 6 of the handle 1. The lockers 305 are positioned adjacent the pushing face 301 of the button 3. The lockers 305 are positioned symmetrically with respect to the longitudinal axis of the shaver. The lockers 305 can be offset so as to enable the platform 605 to be positioned between them. This prevents the lockers 305 to be accidentally brought closer together, and thus damaged or disengaged from the handle 1.

The lockers 305, the platform 605, and the pushing face 301 of the button 3 form together an opening, through which the plunger 4 protrudes. The plunger 4 is configured to reciprocate in the opening. The plunger 4 includes a cam following face 41, which engages the cartridge 2, and ensures that the cartridge 2 is returned to its rest position when pivoted.

Each of the lockers 305 is provided in a form of an outwardly oriented hook. When the button 3 is in the rest position, the lockers 305 engage the linear part 610 of the non-linear slot 604. The end portions of the lockers 305 engage depressions 610A in the bottom part of the arms 602. Therefore the lockers 305 are further prevented from unwanted movements and/or disengaging from their position.

The lower portion of the button 3 includes a pair of pins 306. The pins 306 are positioned so as to engage the receptacles 603 which are provided in the arms 602 of the yoke. The receptacles 603 may be in the form of grooves, which can be non-rectilinear and may be oriented slantwise, outwardly forwardly. Example receptacles 603 are shown on FIG. 5A.

The pins 306 provide means for moving the arms 602 closer together when the cartridge 2 is to be disengaged. When the button 3 is pressed by the user, the button 3 slides forward, towards the cartridge 2. The pins 306 move forward in the receptacles 603, thus forcing the arms 602 to flex and move closer together. At the same time, the cartridge 2 is encountered by the pushing face 301 of the button 3. The shell bearings 602A thus disengage from the corresponding features on the cartridge 2. At the same time, the cartridge 2 is urged away from the shell bearings 602A by the pushing face 41 of the plunger 4. Therefore the cartridge 2 is removed from the handle 1 and can be replaced with a new cartridge 2.

Figure 4A:
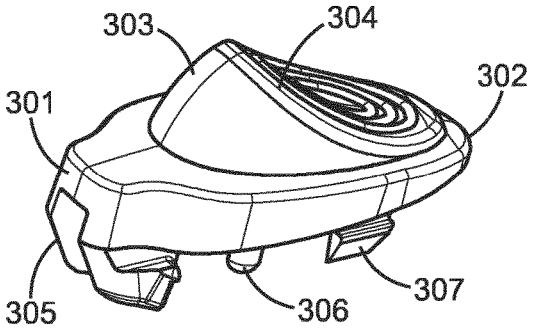
FIGS. 4A-4D show various views of the button.
Figure 4B:
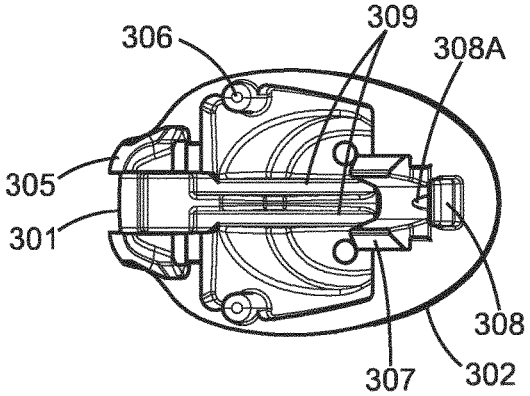
Figure 4C:
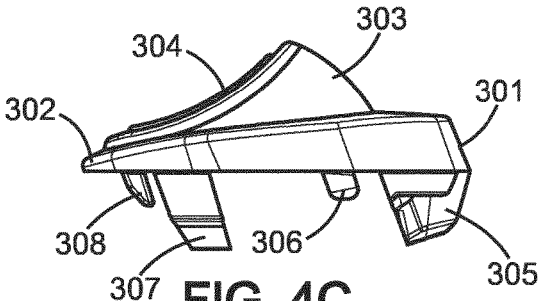
Figure 4D:
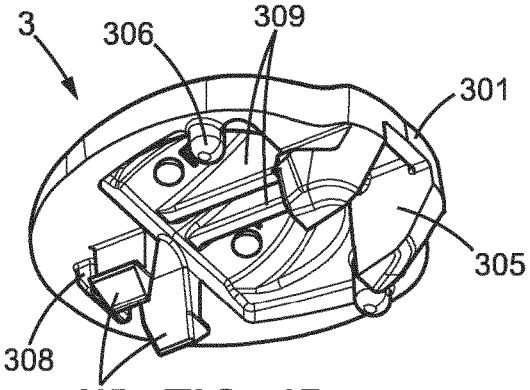

The lower portion of the button 3 can further include a track 309 (for an example, see FIGS. 4B and 4D). The track 309 extends in a longitudinal direction of the button 3, the track 309 being parallel to the longitudinal axis of the shaver. The track 309 may extend along a majority of the length of the button 309. The track 309 is configured to receive the guiding protrusion 42 of the plunger 4. In this way, the track 606 provided on the platform 605 cooperates with the track 309 provided on the button 3 and provides guidance for the plunger 4. The correct function of the plunger 4 is therefore secured. Furthermore, the track 309 may serve as a reinforcement of the button 3.

The lower portion of the button 3 further includes flexible hooks 307. In at least one embodiment of the present invention, there is an even number of flexible hooks 307; in the example from FIGS. 4A to 4D, there is a pair of flexible hooks 307. The flexible hooks 307 are provided adjacent the back portion of the button 3. The flexible hooks 307 protrude downwards from the button 3, and extend through the slot 609 provided between the platform 605 and the grip area 601 of the upper part 6 of the handle 1. The flexible hooks 307 take an overall shape of a hook, with the bent portion being positioned in the lower part of the flexible hooks 307. The hooks forming the lower part of the flexible hooks 307 are outwardly oriented (i.e. bent outwards). Thus, the flexible hooks 307 are opposed. In at least one embodiment of the present invention, the flexible hooks 307 engage the side walls of the slot 609. The flexible hooks 307 are sufficiently long for the hooks to extend below the side walls of the slot 609. In this way, the flexible hooks 307 engage the two longitudinal edges forming a pair of opposed tracks as they are formed in the slot 609. The hooks are then held by the end of the side walls of the slot 609. The flexible hooks 307 may be snap-fitted with the tracks. These features prevent the button 3 from easy disengagement.

In at least one embodiment of the present invention, there is a free space between the flexible hooks 307. The plunger 4 is positioned so as to be able to pass through the free space between the flexible hooks 307 and to reciprocate in there.

The flexible hooks 307 are configured to be put through the slot 609 of the front portion 6A of the handle 1. The hooks of the flexible hooks 307 can engage the elongated walls of the slot 609, thus holding the button 3 in place.

The dimensions of the flexible hooks 307 and the slot 609 are set so as to allow the flexible hooks 307 to move in the slot 609 when the button 3 is slid towards the cartridge 2. However, the flexible hooks 307 are not allowed an unlimited movement, as they are stopped by the walls of the slot 609 that are perpendicular to the side walls of the slot 609.

In the slot 609, the stop projection 608 (described above) is provided. The stop projection 608 is arranged so as to extend between the flexible hooks 307. The stop projection 608 is positioned below the normal position of the plunger 4. The stop projection 608 prevents the flexible hooks 307 to be brought closer together; thus, the hooks forming the lower part of the flexible hooks 307 cannot easily disengage from the side walls of the slot 609, and the risk of displacement or disengagement of the button 3 is lowered.

Figure 7:
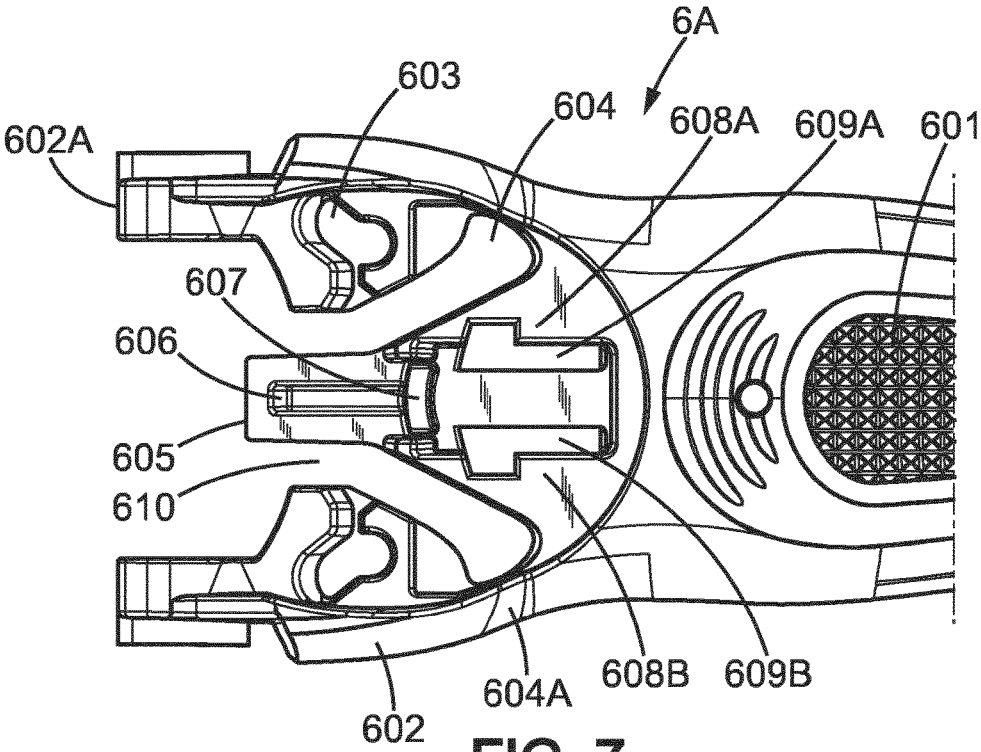
FIG. 7 is a detail of the front portion of the upper part of an alternative embodiment of the handle viewed from above.
Figure 8:
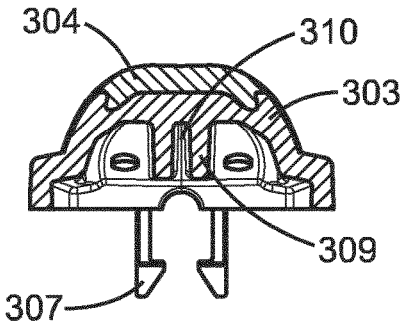
FIG. 8 is a cross section of a button of an alternative embodiment.

In an alternative embodiment of the present invention, details of which are shown on FIGS. 7 and 8, the flexible hooks 307 may be inwardly oriented. The upper part 6 of the handle 1 may be provided with a pair of parallel slots 609A, 609B, forming a body between them. The flexible hooks 307 then engage the body between the slots. For the flexible hooks 307 to be prevented from disengaging, a pair of stop projections 608A, 608B may be provided, the stop projections 608A, 608B being positioned on the outer side of the flexible hooks 307. In such a situation, the stop projections 608A, 608B may be positioned either on the upper part 6 of the handle 1, or on the lower part 8 of the handle, close to the abutment member 804.

The button 3 is further provided with a coil spring support 308 (an example of such support is given on FIGS. 4B and 4C). The coil spring support 308 is positioned opposite the pushing face 301 of the button 3, on the longitudinal axis of the button 3. The coil spring support 308 is configured to support one end of the coil spring 5. In the illustrated embodiment of the present invention, the coil spring support 308 is provided with a pin-like protrusion 308A, on which the coil spring 5 is fitted. The pin-like protrusion 308A prevents the coil spring 5 from being disengaged from the coil spring support 308, and thus displaced and/or damaged.

One end of the coil spring 5 is inserted into the hole 43 provided in the back part of the plunger 4. The opposite end of the coil spring 5 is supported by the coil spring support 308. When a force is applied on the cartridge 2, for example when the cartridge 2 is pivoted, the plunger 4 is pressed inwardly, and the coil spring 5 is compressed. When the force is removed, the coil spring 5 returns to its initial position, thus urging the plunger 4 to press the cartridge 2 and return it to its rest position.

Further, when the cartridge 2 is to be removed, for example when the button 3 is pressed and moved forward, the coil spring support 308 moves the coil spring 5 together with the plunger 4. The plunger 4 stops moving forward when the plunger 4 encounters the end of the guiding track 606 of the platform 605; the coil spring 5 is further compressed by the further forward movement of the button 3. Subsequently, when the cartridge 2 is disengaged and the button 3 is released, the coil spring 5 helps to return the button 3 into its original position via the pressure applied by the coil spring 5 onto the coil spring support 308.

The abutment member 804 and the stop projection 608 are positioned so as to provide a possibility to easily attach the button 3 as well as allow an easy assembly of all parts of the handle 1, for example the button 3, the plunger 4, the coil spring 5, and the upper and lower parts 6, 8 of the handle 1.

To this end, the abutment member 804 may have a length as to not extend along the whole length of the slot 609. In at least one embodiment of the present invention, the abutment member 804 extends along approximately half the length of the slot 609. The stop projection 608 also does not extend along the whole length of the slot 609. The stop projection 608 is at most of the same length as the abutment member 804.

Further, the flexible hooks 307 of the button 3 have a width as to allow the button 3 to be snap-fitted to the upper part 6 of the handle 1 through the slot 609 without the stop projection 608 interfering with the process.

Further, the width of the flexible hooks 307 is such that the abutment member 804 does not interfere with the flexible hooks 307 when the lower part 8 of the handle 1 is assembled to the assembly of the upper part 6 of the handle 1, the plunger 4 and the button 3.

Moreover, the width of the flexible hooks 307, and the length of the stop projection 608 and the abutment member 804 may be set such that when the button 3 is slid forward, the flexible hooks 307 engage the abutment member 804 before the flexible hooks 307 lose contact with the stop projection 608. In this way, the flexible hooks 307 are in a contact with disengagement preventing features at all times. In an alternative embodiment of the present invention, the abutment member 804 is so long as to cover substantially the whole length of the slot 609. In this embodiment, the stop projection 608 may be missing, and the whole abutment member is positioned on the lower part 6 of the handle 1.

When the button 3, the plunger 4, and the upper and lower parts 6, 8 of the handle 1 are being assembled together, the following steps may be performed.

The plunger 4, the coil spring 5 and the button 3 are assembled. To this end, the button 3 is provided with a coil spring support 308, and the plunger 4 is provided with the hole 43. The coil spring is inserted into the hole 43 of the plunger 4, and engaged to the coil spring support 308. In an alternative embodiment of the present invention, the plunger 4 can be omitted, and the coil spring 5 is assembled directly to the button 3.

Subsequently, the assembly of the button 3, the plunger 4 and the coil spring 5 is snap-fitted to the upper part 6 of the handle 1. During this process, the flexible hooks 307 of the button 3 are put through the slot 609, and snap-fitted to the tracks formed by the side walls of the slot 609. The flexible hooks 307 are put through the slot 609 in a way to avoid contact with the stop projection 608. The button 3 with the plunger 4 and the coil spring 5 are thus introduced into the front portion of the slot 609, i.e. the portion adjacent the shell bearings 602A.

The coil spring 5 pushes the button 3 backwards. The flexible hooks 307 of the button 3 therefore engage the stop projection 608 provided in the back portion of the slot 609.

Afterwards, the lower part of the handle 8 is fitted to the assembly. The hook 802 is introduced into the hook-like receptacle 607. The abutment member 804 is introduced between the flexible hooks 307. The snap-fitting means 611, 806, 612, 805, as well as the press-fitting means 616, 807, are engaged and fitted together, and the handle 1 is assembled.

Of the above described features of the shaver, several features serve to help to prevent the disengagement of the button 3 and/or to help to prevent the disassembly of the upper part 6 and the lower part 8 of the handle 1.

The upper part 6 of the handle 1 is provided with hooks 611, 612. The lower part 8 of the handle 1 is provided with receptacles 806, 805. These features are compatible; the hooks 611, 612 are adapted to be snap-fitted with the respective receptacles 806, 805. Therefore, the upper part 6 and the lower part 8 of the handle 1 are held together.

The rear portion 6B of the upper part 6 of the handle 1 may be provided with upper press-fitting means 616. The rear portion 8B of the lower part of the handle 1 may be provided with lower press-fitting means 807. These features help to increase the reliability of the assembly of the upper part 6 and the lower part 8 of the handle 1. In particular, with these features it is difficult to dismantle or disassemble the handle 1 from its rear portion 6B, 8B. As there is an increased risk that the handle 1, when dropped, will hit the ground with either the front or the rear portion, these features help to prevent the disassembly of the handle 1.

The front portion 6A, 8A is provided with the cartridge-receiving region, and with the features providing for locking the cartridge 2 and releasing it when needed. These features include the yoke with the shell bearings 602A, the plunger 4, and the button 3. The button 3 is mounted on the front portion 6A of the upper part 6 of the handle 1. The button 3 includes features for accommodating the plunger 4, such as track 309. The button 3 further includes locators 305 and flexible hooks 307, which are positioned so as to allow the plunger to reciprocate directly under the button 3.

The front portion 6A of the upper part 6 of the handle 1 is provided with the platform 605, a linear part 610 of the non-linear slot 604, the depressions 610A provided in the bottom part of the arms 602, the slot 609, and the stop projection 608. All of these features cooperate with the corresponding features provided on the button 3 to help prevent the button 3 from being displaced and/or disassembled from its seating.

The locators 305 are adapted to cooperate with the linear part 610 of the non-linear slot 604, which helps to prevent the locators 305 from being brought closer together and thus disengaged from the depressions 610A provided in the bottom part of the arms 602.

The flexible hooks 307 are configured to cooperate with the slot 609, which locks the flexible hooks 307 and thus holds the button 3 in place. The flexible hooks 307 are further configured to cooperate with the stop projection 608, which helps to prevent the flexible hooks 307 from being brought closer together and thus disengaged from side walls of the slot 609. Further the front portion 8A of the lower part 8 of the handle 1 is provided with abutment member 804, which also helps prevent the flexible hooks 307 from being brought closer together and/or disengaged from the side walls of the slot 609. At the same time, these features do not obstruct the back-and-forth movement of the button 3, thus ensuring its function in removing the cartridge 2.

The front portion 6A of the upper part 6 of the handle 1 is further provided with a hook-like receptacle 607. The front portion 8A of the lower part 8 of the handle 1 is provided with corresponding hook 802, which can engage the hook-like receptacle 607 to lock the front portions 6A, 8A of the upper and lower parts 6, 8 of the handle 1 together. This provides an advantageous point where the handle 1 is held together. As there is an increased risk that the handle 1, when dropped, will hit the ground with the front or the rear portion, these features help prevent the disassembly of the handle 1.

The front portion 8A of the lower part 8 of the handle 1 is further provided with the roughened upper surface 803 of the hook 802, and an abutment member 804. Both these features help to prevent displacement of the plunger 4, thus also helping to prevent the damage to the whole lock and release mechanism.

With the above described features, the handle 1 is not easily disassembled. The handle 1 is reinforced, and does not fall apart even when it is subjected to a shock (e.g. when the handle 1 is dropped). It is also not easy to dismount the button 3, and to displace the plunger 4. Subsequently, the both the plunger 4 and the button 3 are less likely to get damaged in such a situation.

With the above described construction, the manufacturing costs are kept low. The amount of material which needs to be used to make the handle is lowered, and if the handle 1 needs to be replaced, the amount of plastic that is thrown away is also lowered. Yet, due to the sufficient mass of the handle 1, the above construction provides a better control of the shaver during shaving, and a better user experience.

The invention claimed is:

1. A handle for a shaver, comprising:

a front portion configured to receive a removable shaving cartridge, an upper part and a lower part, the upper part and the lower part being assembled together, a button positioned in the front portion of the handle, the button being movable in a first direction and configured to facilitate the removal of the shaving cartridge, wherein the upper part of the handle includes a slot extending longitudinally in the first direction, the slot having two longitudinal edges forming a pair of opposed tracks, wherein the button includes at least one pair of opposed flexible hooks which are snap-fitted with the longitudinal tracks of the slot and hold the button onto the handle, the flexible hooks being slideable on the tracks, wherein the lower part of the handle includes an abutment member which is engaged with the flexible hooks and is elongated in the first direction, the abutment member being positioned between the flexible hooks to prevent the flexible hooks from being moved closer together and the abutment member being configured to prevent the flexible hooks from disengaging the tracks of the slot.

2. The handle according to claim 1, wherein the upper part of the handle and the lower part of the handle are assembled together by snap-fitting.

3. The handle according to claim 1, wherein the button is slideable.

4. The handle according to claim 1, wherein the button includes a front portion adjacent the cartridge and a rear portion, and wherein the button is configured to remove the cartridge when the button is moved.

5. The handle according to claim 1, wherein the flexible hooks are provided in a form of outwardly oriented hooks.

6. The handle according to claim 1, wherein the slot includes a stop projection protruding into the slot, the stop projection configured to prevent the flexible hooks to be moved closer together.

7. The handle according to claim 6, wherein the button includes a front portion adjacent the cartridge and a rear portion, the button is slideable and adapted to remove the cartridge when the button is slid forward, the flexible hooks are positioned in the rear portion of the button, and the abutment member engages the flexible hooks when the button is slid forward, while the stop projection engages the flexible hooks when the button is not slid forward.

8. The handle according to claim 1, wherein the front portion of the upper part of the handle includes a receptacle, the front portion of the lower part of the handle is terminated in a hook configured to engage the receptacle, and wherein the rear portions of the upper and lower parts of the handle are provided with press-fitting means.

9. The handle according to claim 8, wherein the abutment member is positioned adjacent the hook.

10. The handle according to claim 1, the handle configured to accommodate a pivoting cartridge, the handle further comprising a plunger configured to enact a force upon the cartridge to return the cartridge into a rest position when pivoted.

11. The handle according to claim 10, wherein each of at least one pair of flexible hooks forms a space between the flexible hooks for accommodating the plunger.

12. The handle according to claim 10, wherein the plunger is provided with a spring, and the spring provides a return force for both the button and the plunger.

13. The handle according to claim 1, wherein the button is provided with a spring, the spring being configured to provide a return force for the button when the button is moved.

14. A shaver comprising a handle according to claim 1.

15. A method of manufacturing a handle for a shaver, the method comprising:

providing a button, the button comprising at least one pair of opposed flexible hooks;

providing a handle upper part, the handle upper part comprising a slot extending longitudinally in a sliding direction, the slot having two longitudinal edges forming a pair of opposed tracks;

providing a handle lower part, the handle lower part comprising an abutment member;

snap fitting the flexible hooks provided on the button respectively to the tracks of the slot on the handle upper part so that the button is slidable in the sliding direction; and fitting the handle lower part to the handle upper part to form the handle, positioning the abutment member between the flexible hooks, the abutment member prevents the flexible hooks from being moved closer together, and engaging the flexible hooks to the abutment member of the handle lower part so that the abutment member prevents disengagement of the hooks from the tracks of the slot.

16. The method according to claim 15, wherein the handle upper part further includes a stop projection protruding into the slot, wherein the method further comprises:

providing a spring;

assembling the button and the spring;

wherein when snap fitting the flexible hooks to the tracks, the flexible hooks are snap fitted at a position offset from the stop projection;

between snap fitting of the flexible hooks to the tracks and fitting of the handle lower part to the handle upper part, the method further comprising:

engaging the flexible hooks to the stop projection, wherein the spring biases the button to a rest position where the stop projection is between the hooks and prevents disengagement of the hooks from the tracks of the slot, and wherein when fitting the handle lower part to the handle upper part, the abutment member of the handle lower part is positioned in alignment with the stop projection in the sliding direction.

17. The method according to claim 15, wherein when fitting the handle lower part to the handle upper part, the upper part of the handle and the lower part of the handle are snap fitted.

* * * * *